US005096056A

United States Patent [19]

Garcia

[11] Patent Number: 5,096,056

[45] Date of Patent: Mar. 17, 1992

[54] MEMENTO BOX

[76] Inventor: Valentin Garcia, 7801 S.W. 32nd Ter., Miami, Fla. 33155

[21] Appl. No.: 680,161

[22] Filed: Apr. 3, 1991

[51] Int. Cl.[5] ..... B65D 6/22

[52] U.S. Cl. ..... 206/45.11; 206/45.31; 220/552; 220/528; 220/527

[58] Field of Search ..... 220/552, 528, 521, 522, 220/554, 523, 525, 527; 206/45.11, 45.14, 45.31, 577

[56] References Cited

U.S. PATENT DOCUMENTS

| | | | |
|---|---|---|---|
| 417,979 | 12/1889 | Borcherdt | 220/522 X |
| 1,644,830 | 10/1927 | Henderson | 220/552 X |
| 1,827,929 | 10/1931 | Bigelow | 220/523 |
| 2,522,768 | 9/1950 | Wiepert | 220/528 X |
| 2,541,890 | 2/1951 | Schaperkotter et al. | 220/522 X |
| 2,718,326 | 9/1955 | Le Blanc | 220/552 X |
| 4,154,356 | 5/1979 | Schieve | 220/523 X |
| 4,595,246 | 6/1986 | Bross | 220/552 X |
| 4,852,725 | 8/1989 | Folsom | 220/552 X |
| 4,932,548 | 6/1990 | Bensinger | 220/552 |
| 4,984,687 | 1/1991 | Hanna et al. | 206/373 |

*Primary Examiner*—Paul T. Sewell
*Assistant Examiner*—Jacob K. Ackun, Jr.
*Attorney, Agent, or Firm*—Robert C. Kain, Jr.

[57] ABSTRACT

The memento box includes a box-like structure having a floor, opposing sidewalls, and a lid hinged to one of the sidewalls. The lid covers the top of the box and defines a closed interior space within the box. A latch or releasable means is provided to keep the lid in a closed position on the box. A plurality of removable and changeable interfitting partitions form a matrix that is sized to fit within the interior space. The height of the partitions and, hence, the matrix is such that when the partitions are placed in the interior space, a book can be stored in the memento box and the interspace within the box above the partitions is at least one-half inch thick to accommodate the book. In addition, the memento box includes a pocket for retaining flat sheet mementos such as photographs. Preferably, the pocket includes a transparent cover. The pocket is attached to the inboard side of the lid. Additionally, the memento box may include a flat divider plate that is removably but securely disposed on top of the interfitting partitions thereby closing the compartments formed by the partitions. The size of the compartments formed by the interfitting partitions can be changed due to complementary slots in the partitions themselves. The person using the box changes the size of the compartments by removing one partition and interlinking different complementary slots on another partition.

3 Claims, 2 Drawing Sheets

MEMENTO BOX

The present invention relates to a specially configured memento box which has interior compartments whose size can be changed, a region for storage of a book above the compartments and a transparent pocket for holding flat sheet mementos on the inboard side of the closeable lid.

BACKGROUND OF THE INVENTION

The storage of mementos customarily presents a problem in that the mementos being stored may be different sizes and the mementos may relate to certain memorable developments recorded in a book. In particular, mementos of the birth and development of an infant are often stored in different locations. These mementos may include pictures of the infant at birth and at varying stages during development, a baby book in which the developmental history of the infant is recorded by the parents or other caretakers, and the storage of other baby mementos such as the baby's first shoes, first rattle, first fork and spoon, locks of hair, teeth, ribbons and various other mementos that have different sizes and yet are relatively small. There is a need for a memento box that can be altered by the user such that the compartments in the box can be configured to store mementos of different sizes, that can store a book that records memorable occasions and provide storage for flat sheet mementos, such as photographs.

OBJECTS OF THE INVENTION

It is an object of the present invention to provide a specially configured memento box that has changeable compartments therein, space for a book at least one-half inch thick, and a pocket for flat sheet mementos such as photographs.

It is another object of the present invention to provide compartments whose size is changed by altering interfitting partitions.

It is a further object of the present invention to provide a memento box that includes a divider plate generally closing the compartments and separating the memento compartments from a separate storage area for the memento book wherein the flat divider plate is placed above the memento compartments.

It is an additional object of the present invention to provide a pocket with a transparent cover such that the flat sheet mementos, such as photographs, can be stored therein and viewed when the lid of the box is open.

It is a further object of the present invention to provide a memento box that is relatively compact in shape such that the mementos, the book, and the photographs can be stored in one compact unit on a shelf.

SUMMARY OF THE INVENTION

The memento box includes a box-like structure having a floor, opposing sidewalls, and a lid hinged to one of the sidewalls. The lid covers the top of the box and defines a closed interior space within the box. A latch or releasable means is provided to keep the lid in a closed position on the box. A plurality of removable and changeable interfitting partitions form a matrix that is sized to fit within the interior space. The height of the partitions and, hence, the matrix is such that when the partitions are placed in the interior space, a book can be stored in the memento box and the interspace within the box above the partitions is at least one-half inch thick to accommodate the book. In addition, the memento box includes a pocket for retaining flat sheet mementos such as photographs. Preferably, the pocket includes a transparent cover. The pocket is attached to the inboard side of the lid. Additionally, the memento box may include a flat divider plate that is removably but securely disposed on top of the interfitting partitions thereby closing the compartments formed by the partitions. The size of the compartments formed by the interfitting partitions can be changed due to complementary slots in the partitions themselves. The person using the box changes the size of the compartments by removing one partition and interlinking different complementary slots on another partition.

BRIEF DESCRIPTION OF DRAWINGS

Further objects and advantages of the present invention can be found in the detailed description of the preferred embodiment when taken in conjunction with the accompanying drawings in which.

DETAILED DESCRIPTION OF THE PREFERRED EMBODIMENT

The present invention relates to a memento box that is particularly designed and constructed to provide changeable and removable interfitting partitions, to provide for the storage of a book at least one-half inch thick above the partitions, a flat sheet memento pocket on the inboard side of the lid, and other features that are described herein.

Figure 1:
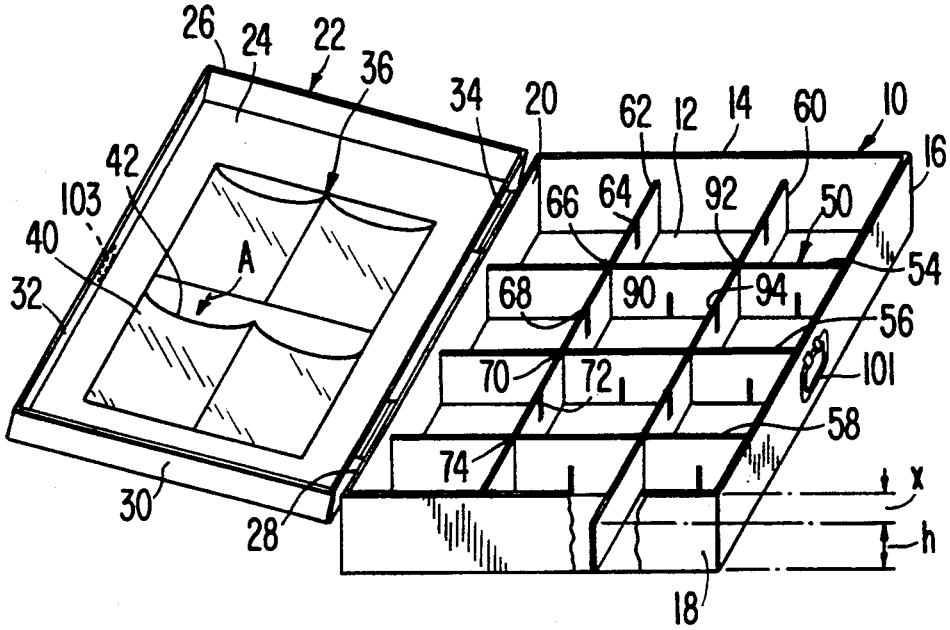
FIG. 1 is a perspective view of the memento box constructed in accordance with the principles of the present invention.

FIG. 1 is a perspective of memento box 10. Box 10 includes floor 12 and sidewalls 14, 16, 18 and 20. The sidewalls extend upward from floor 12. Box 10 also includes lid 22 that has a ceiling 24 and depending lid sidewalls 26, 28, 30 and 32. Lid 22 is hinged to sidewall 20 by a pair of hinges, one of which is hinge 34.

A pocket means 36 for retaining flat sheet mementos is attached to the inboard side of lid ceiling 24. As used herein, the term "inboard" refers to items closer to the interior of box 10. The term "outboard" refers to items disposed further away from the interior of box 10. Accordingly, pocket means 36 is disposed on the inside or inboard surface of lid ceiling 24. In the illustrated embodiment, pocket means 36 includes four pockets, one of which is pocket 40. The illustrated embodiment has four pockets which together comprise pocket means 36. Each pocket has a cover such as cover 42 for pocket 40. Pocket cover 42 is made of a transparent material such that a flat sheet memento, such as a photograph, can be inserted in the direction shown by arrow A into pocket 40 and be viewable to the user when lid 22 is open. These flat sheet mementos can be photographs, baby announcements, wedding announcements, or anything that is essentially flat. In the preferred embodiment, the entire pocket means 36 is made of a transparent plastic material that is glued or affixed to the inside of lid ceiling 24.

Figure 2:
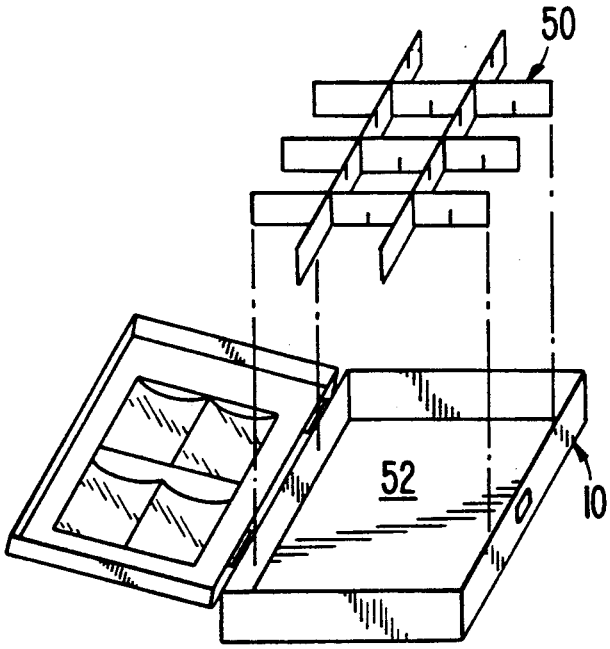
FIG. 2 is a perspective view of the memento box showing the interfitting partitions being removed from the interior space of the box.

One of the unique features of the memento box is the removable and changeable interfitting partitions. FIG. 2 illustrates interfitted partition matrix 50 removed from interior space 52 of box 54. The removability of interfitted partition matrix 50 is an important feature of the present invention. Interfitted partition matrix 50 is formed by a plurality of partition plates which are, in the present invention, plates 54, 56, 58, 60 and 62. Each plate has a plurality of half-height slots therein. For example, plate 62 has half-height slots 64, 66, 68, 70, 72, and 74. Partition plates 54, 56 and 58 have complementary half-height slots that are interfit into slots 66, 70 and 74 of partition plate 62.

Figure 3:
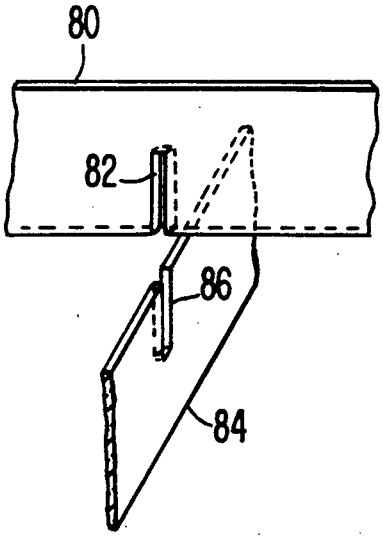
FIG. 3 is a perspective view of the complementary slots on a pair of partition plates.

FIG. 3 illustrates the principle of interfitting the half-height slots. In that figure, partition plate 80 has half-height slot 82 formed in its lower region. Partition plate 84 has half-height slot 86 formed in its upper region. Slot 82 interfits with slot 86 such that when plate 80 is linked or joined with plate 84, the total height of both interfitted plates equals the height of a single partition plate. Of course, the height of slots 82 and 86 can be changed as long as when the pair of interfitted plates are joined or interfit together, the total height of the joined plates is not substantially greater than the height of a single plate. Accordingly, when two or more partition plates are interfit together, those plates form a matrix of compartments. In FIG. 1, matrix 50 defines a plurality of compartments, one of which is compartment 90. Additionally, the partitions can be held in the matrix by a key and keyway lock system in the slots, by a rotating slot cover plate, by clips attached to the interfit corners of the partitions and other by other means.

The size of compartment 90 can be easily changed by the user in accordance with the principles of the present invention. In the illustrated embodiment, partition plate 60 includes a number of half-height slots, two of which are slots 92 and 94. The size of compartment 90 can be changed by simply lifting partition plate 54, thereby removing that partition plate from slots 66 and 92 of partition plates 62 and 60, and then interfitting plate 54 into slots 68 and 94 of plates 62 and 60. Preferably, the longitudinally extending partition plates 60 and 62 have a reasonable number of half-height slots and the laterally extending partition plates 54, 56 and 58 also include a reasonable number of half-height slots that are complementary to the slots in longitudinal partitions 60 and 62. Accordingly, the longitudinal aspect of compartment 90 can be changed as well as the latitudinal aspect thereof. The complete removability of interfitted partition matrix 50 enables the user to quickly and easily change the size of the compartments. This is an important feature of the present invention because mementos come in varying sizes. For example, there are many sizes for a baby's rattle. On the other hand, there is a typical size for a baby's first pair of shoes. When various types of mementos, such as baby shoes, baby rattles, baby forks and spoons, hair, teeth, etc. are to be stored in the memento box, the removability and changeability of the interfitted partitions is an important feature because the size of the memento compartments can be changed to accommodate mementos of different sizes.

Another important feature of the present invention is the height h of the partitions with respect to either the total height of the interior space 52 or, more importantly, the height of an interspace immediately above compartment matrix 50 which is identified as height x in FIG. 1. Height x must be at least one-half inch in order for the user to store a book atop the compartments defined by matrix 50. The storage of a book, mementos, and flat sheet mementos in a single memento box is an important feature. Preferably, height x is about one inch to one and one-half inches.

The overall dimensions of the memento box are also important. The box is preferably sized such that it can be stored on a book shelf. Accordingly, the memento box should be generally less than 13" along its longitudinal aspect, less than 12" along its latitudinal aspect, and no more than 4" in total height (h+x).

When lid 22 is in a closed position, the peripheral portions of the lid (those peripheral portions formed by lid sidewalls 26, 28, 30 and 32) are adjacent the top edges of sidewalls 14, 16, 18 and 20. Box 10 also includes a releasable means for latching and keeping lid 22 closed atop box 10. Latch 101 on sidewall 16 is a clasp that cooperates with hook 103 on lid sidewall 32. Clasp 101 is on the outboard side or exterior of sidewall 16 and the hook 103 is on the outboard or exterior side of lid sidewall 32.

Figure 4:
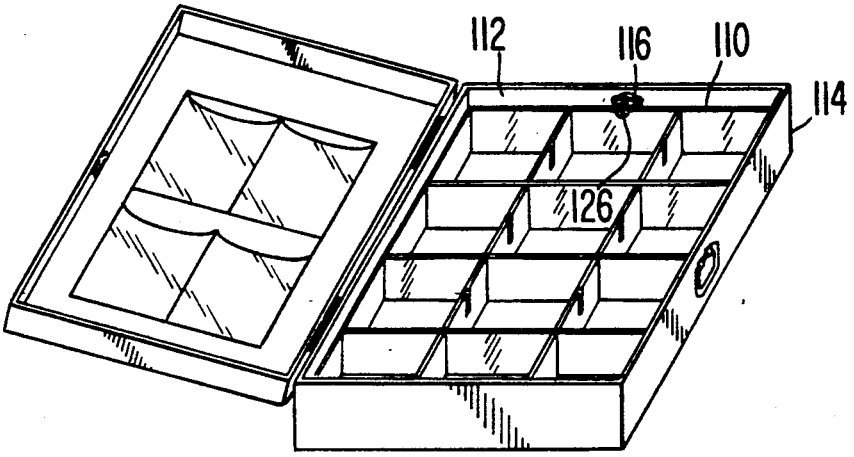
FIG. 4 is a perspective view illustrating the memento box with the flat divider plate disposed therein.

In order to keep the mementos in the compartments defined by matrix 50, a divider plate 110, shown in FIG. 4, can be utilized. Preferably, divider plate 110 is transparent such that the user can see the mementos as he or she reads the book describing, for example, the developmental history of the infant. If the memento box is used for a wedding, a small wedding album can be stored in interspace 112, shown in FIGS. 4 and 5, and the various wedding mementos such as garter belts, party favors, bridesmaids' and bridegroom's gifts can be stored in the compartments while the wedding book is reviewed by the user. In order to keep transparent divider plate securely retained within box 114, a keeper means or latch 116 is utilized.

The transparent divider plate 110 serves two purposes. First, it closes the open tops of the compartments that are defined by matrix 50. This closure ensures that the mementos are securely retained in the compartments. Secondly, divider plate 110 separates the compartments from interspace 112. The book is stored within interspace 112. Accordingly, the interspace must be large enough to hold a book. The interspace must be at least one-half inch high. The size of the interspace may be expanded by increasing the height of lid sidewalls 26, 28, 30 and 32 since the book storage area includes not only the region immediately atop the divider plate 110, but also the interior space defined by lid ceiling 24 and the various sidewalls. However, sufficient space must be set aside for flat sheet mementos stored in pocket means 36.

Figure 5:
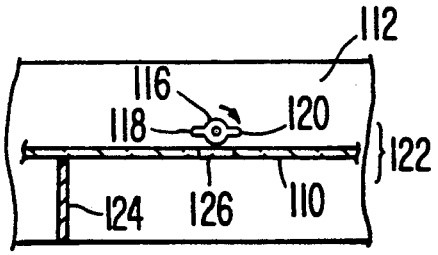
FIG. 5 is an illustration of the releasable latch mechanism for the divider plates.

FIG. 5 illustrates latch 116 that includes arms 118 and 120 which prohibit upward movement of divider plate 110 when the plate is placed atop the matrix of compartments. Divider plate 110 is retained in mid region 122 of the box by the matrix of partitions, one of which is partition 124 in FIG. 5, and latch 116. To remove divider plate 110, the user rotates keeper 116 such that arms 118 and 120 are vertically disposed. The divider plate can be vertically raised by passing latch 116 through cutout 126 in the plate. A similar latch and cutout system (not shown) is located on the opposing sidewall of the box. The divider plate may have finger holes therethrough such that the user can easily left the plate by the finger holes (not shown).

It should be appreciated that the latch mechanism for the box proper can be constructed in many ways as is known to persons of ordinary skill in the art. The particular configuration of a transparent divider plate, pockets attached to the inside of lid 24 having transparent covers, the changeable and removable interfitted partitions forming a matrix and hence, forming compartments, and the particular low level height of the partition matrix all operate together to provide a unique box for the storage of mementos.

The claims appended hereto are meant to cover modifications and changes within the spirit and scope of the present invention.

What is claimed is:

1. A memento box comprising:

an open top box-like structure having a floor, opposing sidewalls extending upwards from the floor;

a lid hinged to one of said sidewalls of said open top structure and sized to cover and close the open top of said box-like structure;

an interior space defined within said box-like structure which is closed when peripheral portions of said lid are placed adjacent a top edge of all of said sidewalls;

releasable means for keeping the lid in a closed position adjacent the top edges of said sidewalls;

a plurality of removable and changeable interfitting partitions, said interfitting partitions forming a matrix sized to fit within said interior space of said box-like structure, the height of all of the partitions being less than the height of said interior space such that when said interfitting partitions are disposed within said interior space and said lid closes said interior space, an interspatial void is formed above top edges of said interfitting partitions and below an imaginary plane defined by said top edge of all of said sidewalls, said interspatial void being large enough to hold at least a one-half inch thick book therein;

a removable, transparent divider plate sized to fit over said interfitting partitions when said partitions are disposed in said interior space, said divider plate defining a floor for said interspatial void; and, at least one transparent pocket sized to fully cover and retain a photograph therein, said pocket being affixed to an interior surface of said lid and being viewable when said lid uncovers said interior of said lid and being viewable when said lid uncovers said interior space and interspatial void, thereby permitting simultaneous viewing of said photograph and the entire matrix and mementos stored therein.

2. A memento box as claimed in claim 1 including a divider plate keeper means for removably retaining said divider plate atop said interfitting partitions.

3. A memento box as claimed in claim 2 wherein said interfitting partitions include a plurality of plates, each plate having a plurality of slots, said plates being interfit together by interlocking complementary slots on respective plates to form said matrix of interfitting partitions, said matrix forming compartments when said interfitting partitions ar placed in said interior space, the size of said compartments being changeable due to the number of slots per plate and the number of interlocking complementary slots on respective plates.

* * * * *